US006452335B1

(12) United States Patent
Tsuida

(10) Patent No.: US 6,452,335 B1
(45) Date of Patent: Sep. 17, 2002

(54) FIELD EMISSION TYPE COLD-CATHODE ELECTRON GUN WITH FOCUSING ELECTRODE

(75) Inventor: Shunji Tsuida, Tokyo (JP)

(73) Assignee: NEC Corporation (JP)

( * ) Notice: Subject to any disclaimer, the term of this patent is extended or adjusted under 35 U.S.C. 154(b) by 162 days.

(21) Appl. No.: 09/669,111

(22) Filed: Sep. 25, 2000

(30) Foreign Application Priority Data

Sep. 29, 1999 (JP) ..... 11-276013

(51) Int. Cl.[7] ..... H01J 17/04
(52) U.S. Cl. ..... 313/631; 313/491
(58) Field of Search ..... 313/446, 491, 313/631, 270, 328

(56) References Cited

FOREIGN PATENT DOCUMENTS

| | | | |
|---|---|---|---|
| JP | 9-129144 | 5/1997 | ..... H01J/23/06 |
| JP | 10-106430 | 4/1998 | ..... H01J/1/30 |
| JP | 10-125242 | 5/1998 | ..... H01J/23/06 |
| JP | 11-273550 | 10/1999 | ..... H01J/1/30 |

*Primary Examiner*—Vip Patel
(74) *Attorney, Agent, or Firm*—Hayes Soloway P.C.

(57) ABSTRACT

A cold-cathode electron gun includes a cold cathode, a conical Wehnelt electrode, and an undercut. The cold cathode has an emitter formed on a substrate to emit electrons,. a gate electrode formed on the substrate through a first insulating film so as to surround a distal end of the emitter, and a focusing electrode formed on the gate electrode through a second insulating film to correspond to the gate electrode. The conical Wehnelt electrode connects the focusing electrode to a first external power supply. The Wehnelt electrode has an opening, at its conical distal end, that comes into with the cold cathode to surround an emitter region including the emitter, gate electrode, and focusing electrode. The undercut is formed in a portion of the Wehnelt electrode which is to come into contact with the focusing electrode to correspond to the gate electrode, thereby forming a non-contact portion.

9 Claims, 5 Drawing Sheets

FIELD EMISSION TYPE COLD-CATHODE ELECTRON GUN WITH FOCUSING ELECTRODE

BACKGROUND OF THE INVENTION

The present invention relates to a cold-cathode electron gun serving as an electron source for an apparatus such as a microwave tube as an application of an electron beam and, more particularly, to an electron gun mounted with a field emission type cold cathode with a focusing electrode as a cathode.

The structure of a conventional electron gun mounted with a field emission type cold cathode with a focusing electrode (to be referred to as a cold cathode hereinafter) will be briefly described with reference to FIGS. 4, 5, and 6A to 6C.

As shown in FIG. 4, in a conventional electron gun 31, a conical (trumpet-shaped) Wehnelt electrode 34 with a flange is formed on an electron emission surface 33 of a cold cathode 32, and an emitter electrode 35 with a substantially T-shaped section is formed on the lower surface of the cold cathode 32 on a side opposite to the electron emission surface 33.

The Wehnelt electrode 34 is held as it is fixed with its periphery to a cylindrical support (not shown) arranged around it. The emitter electrode 35 is supported by an emitter electrode support (not shown) through a spring 36. The emitter (not shown) of the cold cathode 32 is connected to an external power supply through the emitter electrode 35 and the emitter electrode support.

The cold cathode 32 is urged by the emitter electrode support and the spring 36 against the central portion of the Wehnelt electrode 34. In other words, the cold cathode 32 is supported as it is sandwiched between the Wehnelt electrode 34 and emitter electrode 35.

The Wehnelt electrode 34 controls the direction of the flow of electrons (electron flow) emitted by the cold cathode 32, and focuses the electron flow. The Wehnelt electrode 34 has an opening 37 formed at its center, and a conical portion 38 formed by bending its portion around the opening 37 conically toward the cold cathode 32. The opening 37 of the Wehnelt electrode 34 passes the electron flow through it, and the distal end of the conical portion 38 is in contact with the cold cathode 32. That portion of the cold cathode 32 which is surrounded by the distal end of the conical portion 38 forms the electron emission surface 33.

The cold cathode 32 has a plurality of emitters 40 formed on the electron emission surface 33 as the surface of the central portion of a substrate 39, and a gate electrode 41 and focusing electrode 42 surrounding the emitters 40, as shown in FIGS. 5 and 6A. The gate electrode 41 is formed on the substrate 39 through a first insulating film 51. The focusing electrode 42 is formed on the gate electrode 41 through a second insulating film 52. Each of the focusing electrode 42, gate electrode 41, and first and second insulating films 51 and 52 is a thin film with a thickness of several $\mu$m or less. Gate electrode interconnections 45 for connecting the gate electrode 41 and gate electrode power supply pads 46 on the periphery of the cold cathode to each other are formed under the focusing electrode 42 through the second insulating film 52.

The emitters 40 formed on the cold cathode 32 emit electrons from their sharp distal ends. The gate electrode 41 generates a strong electric field near the emitters 40 to cause the emitters 40 to emit electrons. The gate electrode 41 is connected to an external power supply through the gate electrode interconnections 45 and gate electrode power supply pads 46, and receives power from it. The focusing electrode 42 is connected to another external power supply through the Wehnelt electrode 34, and forms an electric field that focuses the electron flow emitted from the emitters 40.

The gate electrode power supply pads 46 and the external power supply are connected to each other in a space defined between the upper surface of the Wehnelt electrode 34 and the upper surface of the cold cathode 32 by welding bonding wires 43 to the gate electrode power supply pads 46.

The cold cathode 32 operates on the principle of extracting electrons by concentrating a high-voltage electric field (2 to 5×107 V/cm) to the distal ends of the emitters 40. In order to decrease the operating voltage of the cold cathode 32, the distance between the emitters 40 and gate electrode 41 is preferably as small as possible. The emitters 40 and gate electrode 41 can be designed and manufactured to be close to each other at a distance of as small as on the order of $\mu$m by utilizing a thin film process widely employed in the semiconductor field.

The focusing electrode 42 is usually arranged on the gate electrode 41 through the second insulating film 52 with a thickness of about several $\mu$m by considering matching with the thin film process described above, although it depends on the design conditions.

In order to apply predetermined voltages to the gate electrode 41 and focusing electrode 42 of the cold cathode 32, terminals to be connected to the corresponding external power supplies must extend from the respective electrodes 41 and 42. Since the focusing electrode 42 is exposed to the surface, the Wehnelt electrode 34 is urged against it from the surface, so that the focusing electrode 42 comes into contact with the corresponding terminal. The underlying gate electrode 41 is connected to the external power supply at a position outside the opening 37 of the Wehnelt electrode 34 in order to maintain the axial symmetry of the electric field in the opening 37 of the Wehnelt electrode 34.

More specifically, the gate electrode interconnections 45 for connecting the gate electrode 41 of the cold cathode 32 to the gate electrode power supply pads 46 serving as the terminals to be connected to the external power supply to each other extend under the focusing electrode 42 from a central emitter area 47 to reach the gate electrode power supply pads 46 formed on the periphery of the cold cathode 32. The gate electrode interconnections 45 and focusing electrode 42 are separated from each other by the second insulating film 52 with a thickness of several $\mu$m or less, so that they are insulated from each other.

In the conventional electron gun 31, as shown in FIG. 6B, a contact portion where the Wehnelt electrode 34 is in contact with the focusing electrode 42 extends immediately above the gate electrode interconnections 45. The focusing electrode 42 immediately above the gate electrode interconnections 45 naturally projects from its other portions where the gate electrode interconnections 45 are not present, by a length corresponding to the thickness (t $\mu$m) of the gate electrode interconnections 45. Thus, when the conventional Wehnelt electrode 34 with a flat contact surface is brought into contact with the focusing electrode 42, an excessive stress readily acts on the focusing electrode 42 and second insulating film 52 at the projecting portions.

The second insulating film 52 must have a predetermined thickness near the emitters 40 in order to satisfy the focusing characteristics. Accordingly, even if portions of the second insulating film 52 other than near the emitters 40 are to be made thick, it cannot actually have a thickness greatly exceeding several μm. Hence, as shown by a portion P of FIG. 6C, immediately above the gate electrode interconnections 45 and between the focusing electrode 42 and gate electrode interconnections 45, an excessive stress can cause cracking or the like in the second insulating film 52 with a thickness of several μm or less, thus readily destroying it. As a result, the electrical reliability between the focusing electrode 42 and gate electrode interconnections 45 degrades.

SUMMARY OF THE INVENTION

It is an object of the present invention to provide a cold-cathode electron gun in which the electrical reliability between the focusing electrode and gate electrode is improved while holding the axial symmetry of the electric field in the opening of the Wehnelt electrode.

In order to achieve the above object, according to the present invention, there is provided a cold-cathode electron gun comprising a cold cathode having an emitter formed on a substrate to emit electrons, a gate electrode formed on the substrate through a first insulating film so as to surround a distal end of the emitter, and a focusing electrode formed on the gate electrode through a second insulating film to correspond to the gate electrode, a conical Wehnelt electrode for connecting the focusing electrode to a first external power supply, the Wehnelt electrode having an opening, at a conical distal end thereof, that comes into with the cold cathode to surround an emitter region including the emitter, the gate electrode, and the focusing electrode, and an undercut formed in a portion of the Wehnelt electrode which is to come into contact with the focusing electrode to correspond to the gate electrode, thereby forming a non-contact portion.

DESCRIPTION OF THE PREFERRED EMBODIMENTS

The present invention will be described in detail with reference to the accompanying drawings.

Figure 1:
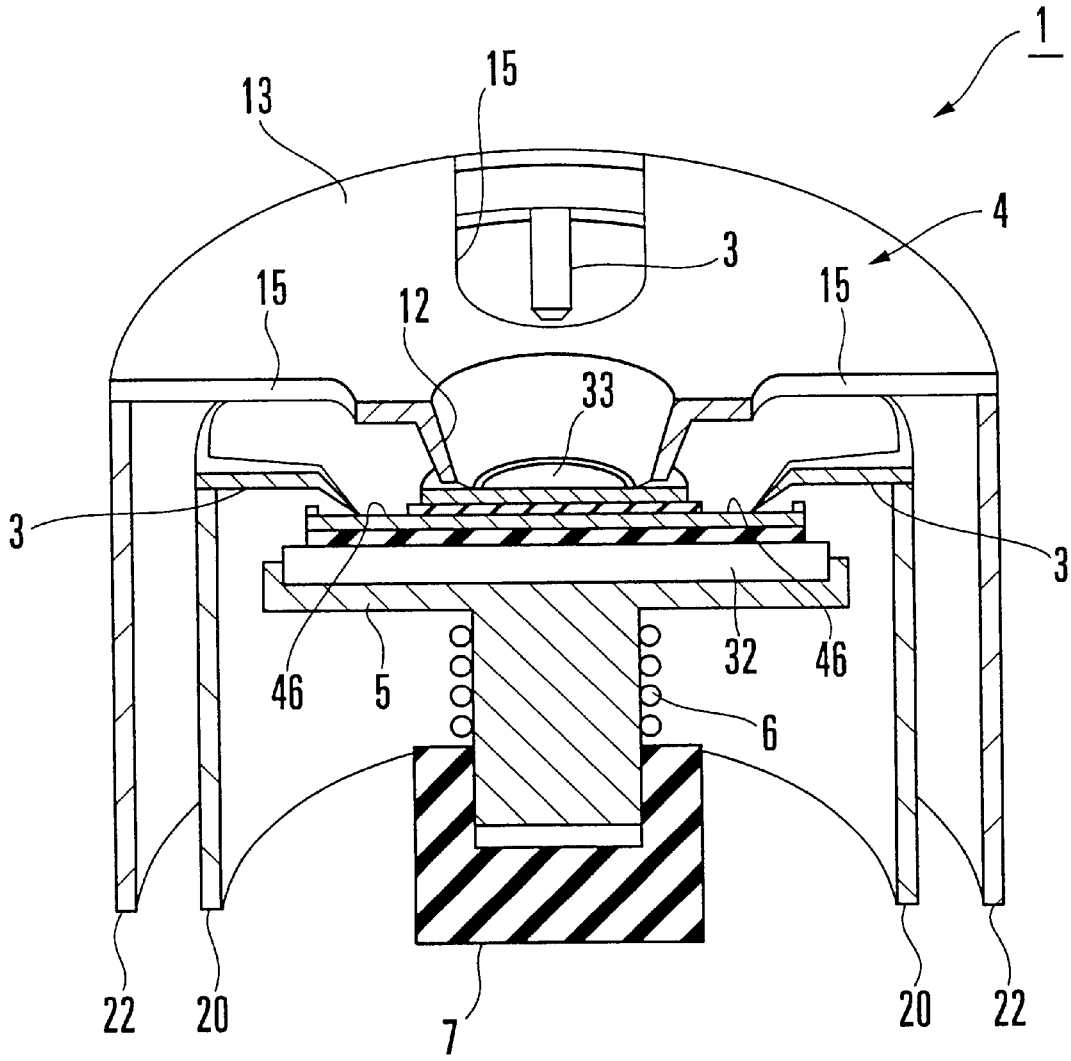
FIG. 1 is a partial sectional perspective view showing the schematic structure of an electron gun according to the first embodiment of the present invention.
Figure 6A:
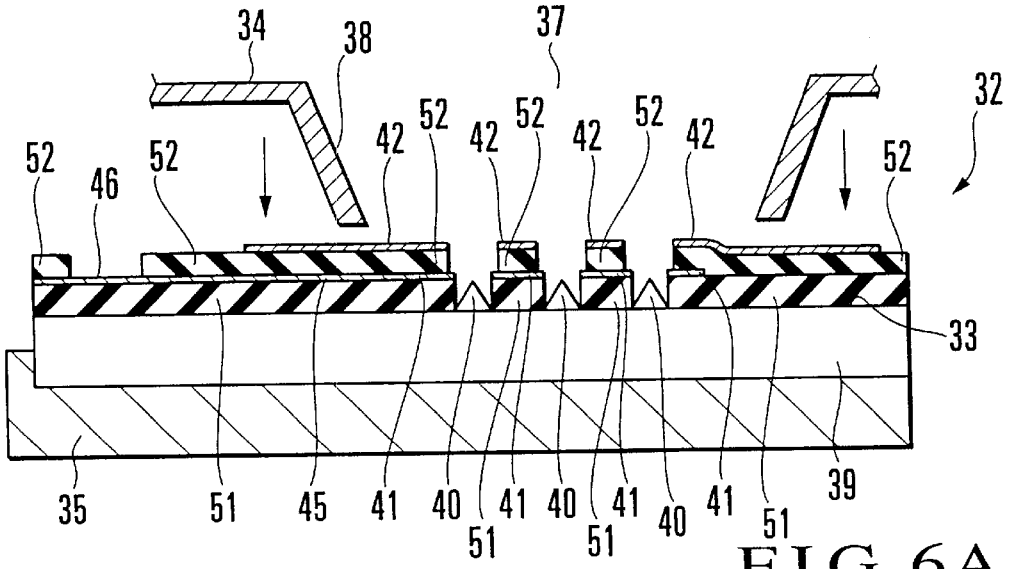
FIG. 6A PRIOR ART
FIGS. 6A and 6B are sectional views taken along the lines X1-X2-X3 and Y1-Y2, respectively, of FIG. 5 to show the relationship between the cold cathode and Wehnelt electrode of the conventional electron gun.
Figure 6B:
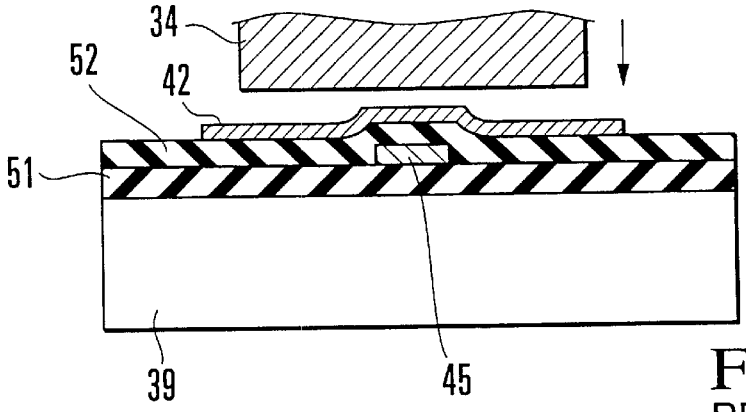
FIG. 6B PRIOR ART
Figure 6C:
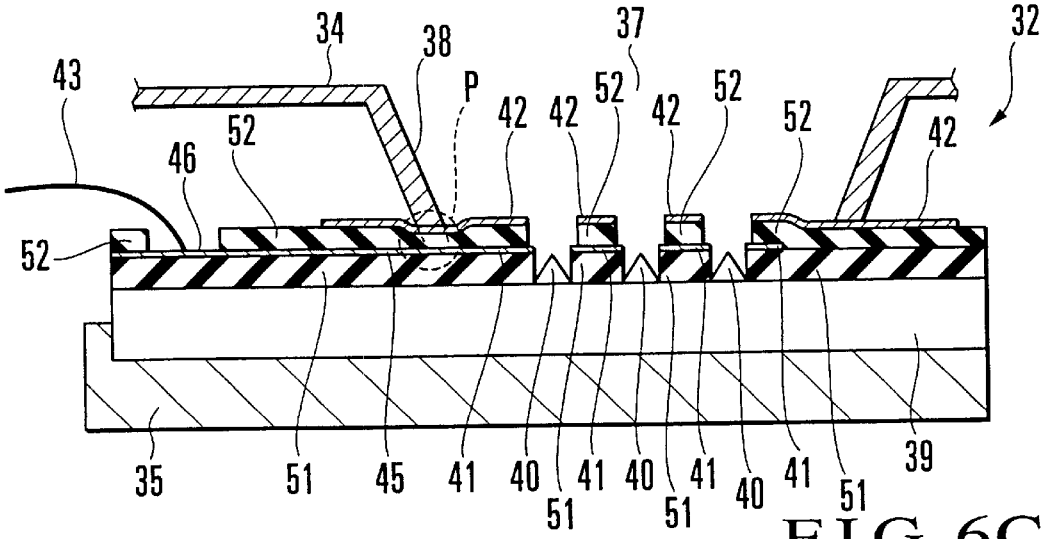
FIG. 6C PRIOR ART
FIG. 6C is a sectional view of the main part to show the contact state of the cold cathode and Wehnelt electrode after assembly.

FIG. 1 shows the schematic structure of a field emission type cold-cathode electron gun according to the first embodiment of the present invention. In FIG. 1, an anode w which faces the Wehnelt electrode to extract electrons from it by applying a high voltage is not shown. The internal structure of the cold cathode is identical to that shown in FIGS. 6A to 6C, and a description thereof will accordingly be omitted.

As shown in FIG. 1, an electron gun 1 has a cold cathode 32 in which emitters 40, a gate electrode 41, and a focusing electrode 42 are formed on an electron emission surface (emitter region) 33, strip-like gate electrode power supply members 3 for connecting the gate electrode 41 of the cold cathode 32 to an external power supply, a conical Wehnelt electrode 4 with a flange, which connects the focusing electrode 42 to an external power supply, an emitter electrode 5 with a substantially T-shaped section provided to come into contact with the lower surface of the cold cathode 32 on a side opposite to the electron emission surface 33, and an emitter electrode support 7 for supporting the proximal end side of the emitter electrode 5 through a spring 6.

The electron gun 1 is housed in a vacuum envelope (not shown) and is held in a high-vacuum atmosphere. An anode (not shown) serving to extract electrons from the Wehnelt electrode 4 is arranged at a position facing the cold cathode 32.

The gate electrode power supply members 3 have projections bent toward the cold cathode 32, and their distal end portions are to come into contact-with gate electrode power supply pads 46. The gate electrode power supply members 3 are supported as they are fixed to the upper end face of a first metal cylindrical support 20 by welding or the like, and are connected to an external electrode through the first cylindrical support 20.

The flange-like edge of the Wehnelt electrode 4 is supported as it is fixed to the upper end face of a second metal cylindrical support 22 by welding or the like, and is connected to the external power supply through the second cylindrical support 22. The second cylindrical support 22 is arranged around the first cylindrical support 20 at a predetermined distance from it.

The cold cathode 32 is mounted to be sandwiched between the Wehnelt electrode 4 and emitter electrode 5. The cold cathode 32 is assembled in the following procedure. First, the cold cathode 32 is supported by the Wehnelt electrode 4 fixed to the second cylindrical support 22. After that, the gate electrode power supply members 3 are fixed.

The structure of the Wehnelt electrode 4 will be described in detail.

Figure 2A:
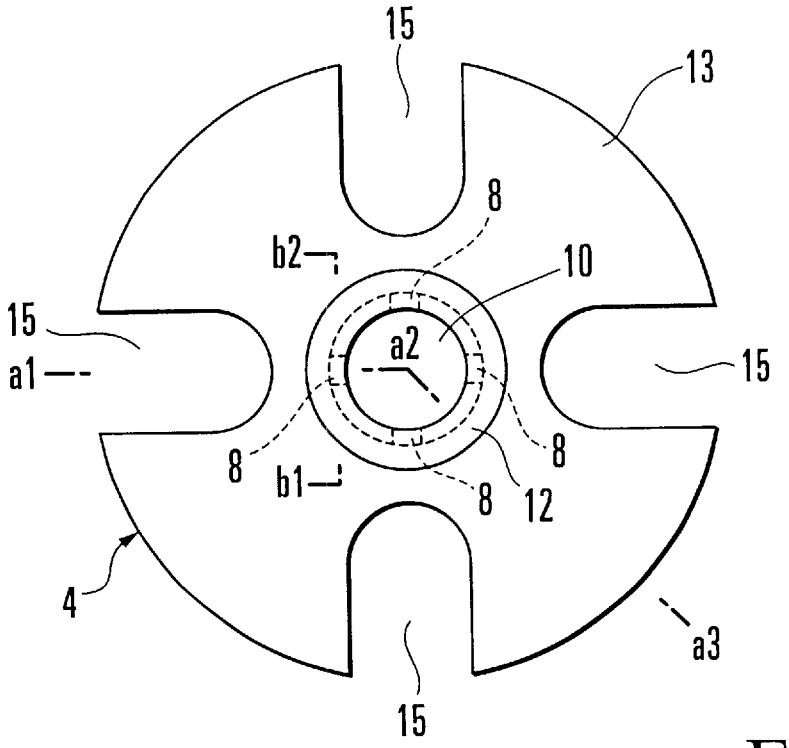
FIG. 2A is a plan view, seen from the cold cathode side, of the Wehnelt electrode shown in FIG. 1.

As shown in FIG. 2A, the Wehnelt electrode 4 has an opening 10 formed at its central portion, a conical portion 12 surrounding the opening 10, a flange 13 with a central portion connected to the conical portion 12 and a edge portion fixed to the second cylindrical support 22, and undercuts (notches) 8 which are formed, immediately above the gate electrode interconnections 45, in the distal end of the conical portion 12 which is in contact with the focusing electrode 42, such that they do not come into contact with the focusing electrode 42. The Wehnelt electrode 4 is assembled such that its undercuts 8 are located immediately above gate electrode interconnections 45.

Figure 2B:
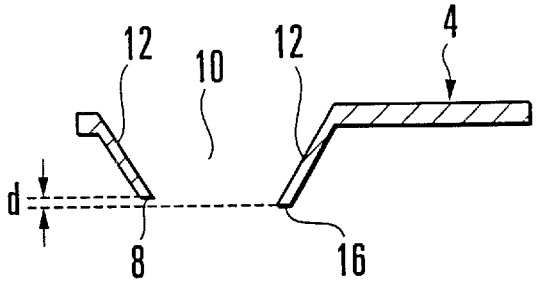
FIG. 2B is a sectional view taken along the line a1-a2-a3 of FIG. 2A.
Figure 2C:
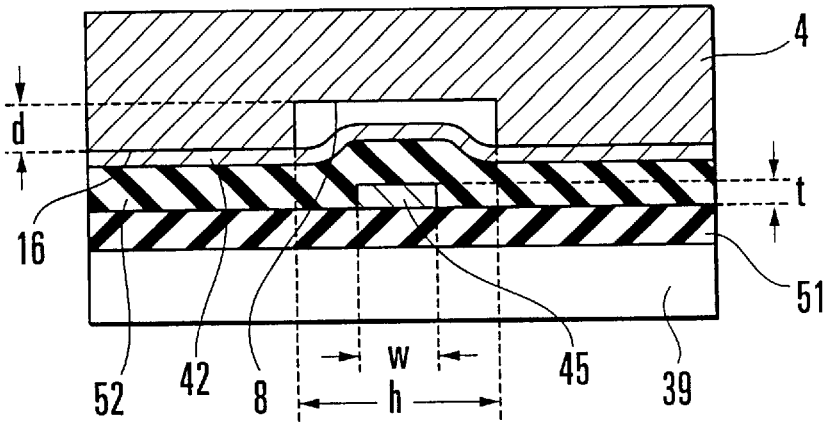
FIG. 2C is a sectional view taken along the line b1-b2 of FIG. 2A to show the contact state of the cold cathode and Wehnelt electrode near the gate electrode interconnection when the Wehnelt electrode shown in FIGS. 2A and 2B is brought into contact with the cold cathode.

The undercuts 8 are formed such that their width h (FIG. 2C) and depth d (FIG. 2B) are respectively larger than at least a width w (FIG. 2C) and thickness t (FIG. 2C) of the gate electrode interconnections 45.

In this manner, the undercuts 8 preferably with the width h (>(w+10 μm)) and depth d (>(t+2 μm)) are formed in the distal end of the conical portion 12 of the Wehnelt electrode 4 located immediately above the gate electrode interconnections 45. The Wehnelt electrode 4 is assembled and fixed such that the undercuts 8 are located immediately above the gate electrode interconnections 45. Hence, immediately above the gate electrode interconnections 45, the Wehnelt electrode 4 does not come into contact with the focusing electrode 42.

The flange 13 of the Wehnelt electrode 4 has notches 15 to correspond to the respective gate electrode power supply members 3, thereby preventing short circuiting between the Wehnelt electrode 4 and gate electrode power supply members 3.

According to this embodiment, the Wehnelt electrode 4 has, immediately above the gate electrode interconnections 45, the undercuts 8 with the depth d and width h sufficiently large with respect to the thickness t and width w of the gate electrode interconnections 45. Even if the distal end of the conical portion 12 of the Wehnelt electrode 4 is urged against the focusing electrode 42, the Wehnelt electrode 4 comes into contact with the focusing electrode 42 only at its contact portions 16, and not at its undercuts 8. As a result, destruction of the second insulating film 52 by the Wehnelt electrode 4 is prevented, and dielectric breakdown between the gate electrode interconnections 45 (gate electrode) and focusing electrode 42 can be prevented.

The operation of the electron gun 1 described above will be described.

In the electron gun 1, an emitter potential is applied to the emitter electrode 5 through the emitter electrode support 7 supported by an envelope (not shown). A positive gate electrode potential of several ten V to a hundred and several ten V with respect to the emitter potential is applied to the gate electrode 41 through the first cylindrical support 20, gate electrode power supply members 3, gate electrode power supply pads 46, and gate electrode interconnections 45. A focusing electrode potential between the emitter potential and gate electrode potential is applied to the focusing electrode 42 through the second cylindrical support 22 and Wehnelt electrode 4. When the gate electrode potential with respect to the emitter potential, and the focusing electrode potential are adjusted, the amount of current and orbits of electrons emitted from the cold cathode 32 are controlled, thereby achieving the electron gun 1.

If the undercuts 8 are formed in the distal end of the conical portion 12 of the Wehnelt electrode 4 which is in contact with the focusing electrode 42, to correspond to the gate electrode interconnections 45, as described above, the axial symmetry of the electric field near the electron flow is distorted not a little at this portion. The smaller the electron gun size, the larger the influence of the axial asymmetry of the electric field on the electron flow. For example, in an electron gun for a traveling wave tube, the higher the frequency, the larger the influence of the axial asymmetry caused by the undercuts 8.

Therefore, the depth d and width h of the undercuts 8 preferably satisfy at least either one of $(t+2\ \mu m) \leqq d < 50\ \mu m$ and $(w+10\ \mu m) < h < (w+200\ \mu m)$, when the trade-off between variations in thickness of the gate electrode interconnections 45 and of the second insulating film 52 on the gate electrode interconnections 45 during the manufacture and the influence on the distortion of the electric field in the opening 10 of the Wehnelt electrode 4, the working precision of the undercuts 8, and the like are considered.

The second embodiment of the present invention will be described with reference to FIGS. 3A to 3C. The second embodiment is different from the first embodiment in only the shape of a Wehnelt electrode 24.

Figure 3A:
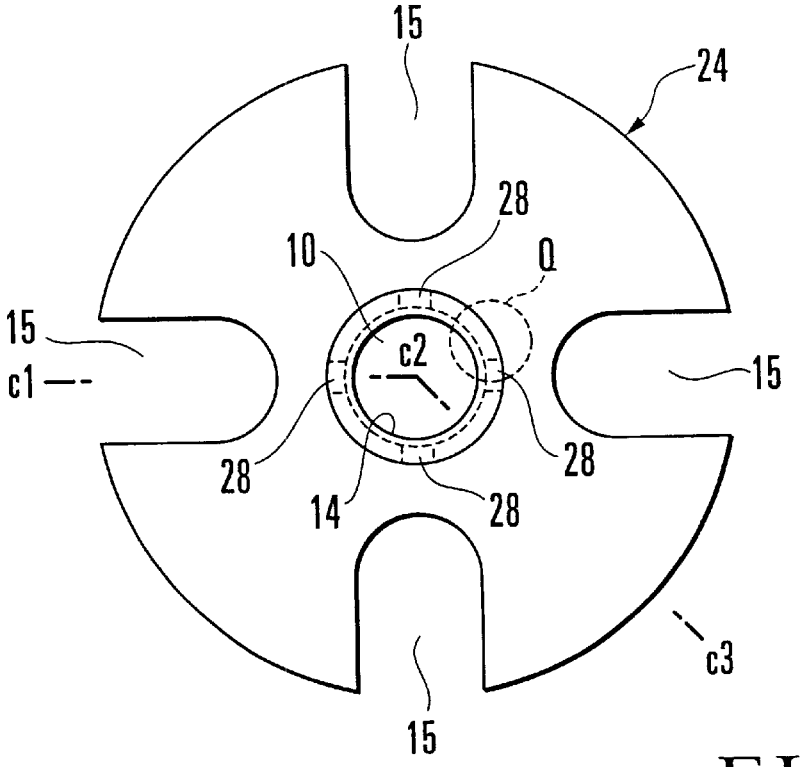
FIG. 3A is a plan view, seen from the cold cathode side, of a Wehnelt electrode according to the second embodiment of the present invention.
Figure 3B:
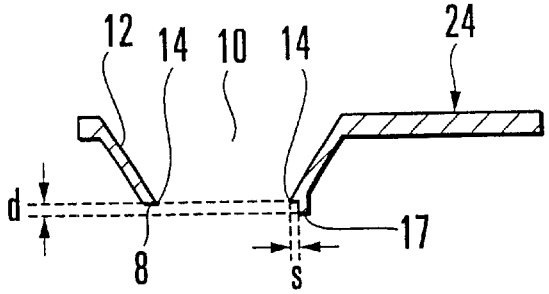
FIG. 3B is a sectional view taken along the line c1-c2-c3 of FIG. 3A.
Figure 3C:
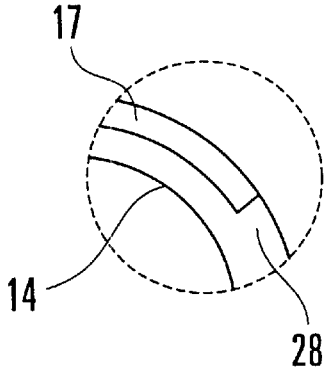
FIG. 3C is an enlarged view of the portion Q of FIG. 3A.
Figure 4:
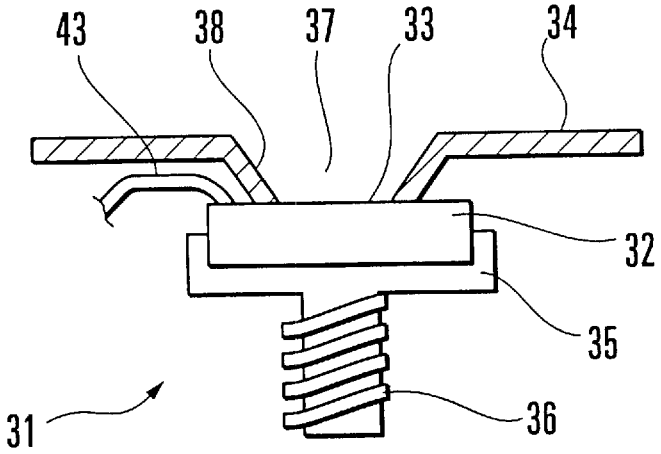
FIG. 4 PRIOR ART
FIG. 4 is a view showing the schematic arrangement of a conventional electron gun.
Figure 5:
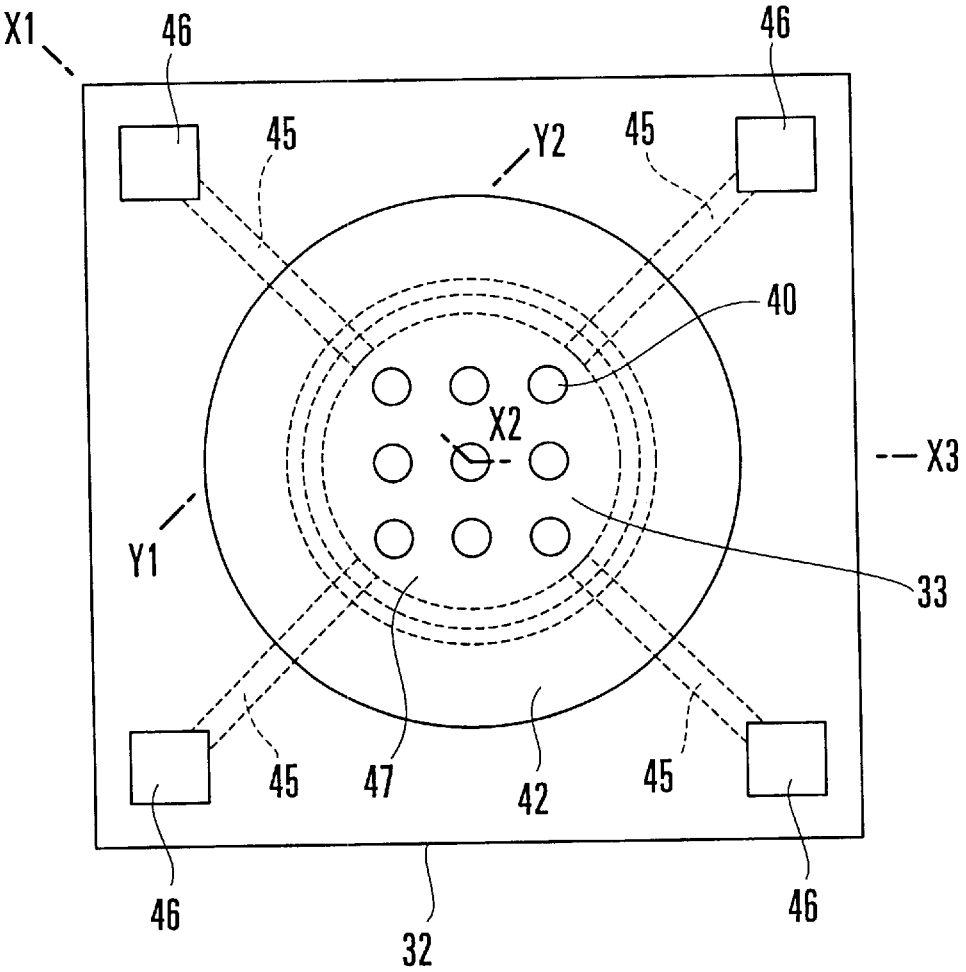
FIG. 5 PRIOR ART
FIG. 5 is a plan view of a cold cathode mounted on the conventional electron gun.

Referring to FIGS. 3A to 3C, of the Wehnelt electrode 24 of this embodiment, contact portions 17 where the Wehnelt electrode 24 comes into contact with a focusing electrode 42 are at portions radially outward from an opening 10 of the Wehnelt electrode 24. More specifically, the diameter of a contact surface where the Wehnelt electrode 24 is in contact with the focusing electrode 42 is larger than the diameter of the opening 10 of the Wehnelt electrode 24.

For this reason, undercuts 28 of the Wehnelt electrode 24 are formed at portions outward from an opening inner edge 14 of the Wehnelt electrode 24 by a distance s to correspond to the positions of the contact portions 17 in the radial direction of the opening 10. Hence, in an electron gun using the Wehnelt electrode 24, distortion in axial symmetry of the electric field near the electron flow, which is caused by the undercuts 28, can be further suppressed.

In the first embodiment, the gate electrode extracting means for connecting the gate electrode 41 and the external power supply is described by way of the gate electrode power supply members 3. Alternatively, as in the conventional electron gun, bonding wires can be used as the gate electrode extracting means, as a matter of course.

As has been described above, according to the present invention, undercuts are formed, immediately above the gate electrode interconnections, in the distal end of a conical portion which is to come into contact with the focusing electrode. Therefore, the second insulating which insulates the gate electrode interconnections and the focusing electrode from each other will not be destroyed. Even if the focusing electrode is damaged at the contact portions where the Wehnelt electrode and focusing electrode are in contact with each other, since no gate electrode interconnections are present under the damaged portions, the gate electrode interconnections and Wehnelt electrode are not electrically connected to each other. As a result, the electrical reliability between the focusing electrode and gate electrode interconnections or gate electrode can be improved.

What is claimed is:

1. A cold-cathode electron gun comprising:

a cold cathode having an emitter formed on a substrate to emit electrons, a gate electrode formed on said substrate through a first insulating film so as to surround a distal end of said emitter, and a focusing electrode formed on said gate electrode through a second insulating film to correspond to said gate electrode;

a conical Wehnelt electrode for connecting said focusing electrode to a first external power supply, said Wehnelt electrode having an opening, at a conical distal end thereof, that comes into with said cold cathode to surround an emitter region including said emitter, said gate electrode, and said focusing electrode; and an undercut formed in a portion of said Wehnelt electrode which is to come into contact with said focusing electrode to correspond to said gate electrode, thereby forming a non-contact portion.

2. An electron gun according to claim 1, further comprising gate electrode extracting means for connecting said gate electrode to a second external power supply through a gate electrode interconnection and a gate electrode power supply pad.

3. An electron gun according to claim 2, wherein said undercut has a notch with a width larger than a width of said gate electrode interconnection and a depth larger than a thickness of said gate electrode interconnection, and said undercut is fixed and located immediately above said gate electrode interconnection, thereby preventing said Wehnelt electrode and said focusing electrode from coming into contact with each other immediately above said gate electrode interconnection.

4. An electron gun according to claim 3, wherein $(t+2\ \mu m) \leqq d < 50\ \mu m$ is satisfied where d is a depth of said undercut and t is a thickness of said gate electrode interconnection.

5. An electron gun according to claim 3, wherein $(w+10\ \mu m) < h < (w+200\ \mu m)$ is satisfied where h is a width of said undercut and w is a width of said gate electrode interconnection.

6. An electron gun according to claim 2, wherein said Wehnelt electrode has at least one notch in a periphery thereof, and said gate electrode extracting means is connected to a gate electrode power supply pad formed on said gate electrode pad to correspond to said notch.

7. An electron gun according to claim 2, wherein said gate electrode extracting means comprises a strip-like power supply member.

8. An electron gun according to claim 2, wherein said gate electrode extracting means comprises a bonding wire.

9. An electron gun according to claim 1, wherein said Wehnelt electrode comes into contact with said focusing electrode at a contact surface, a diameter of which is larger than a diameter of said opening that surrounds said emitter region of said Wehnelt electrode.

* * * * *